US009026013B2

(12) United States Patent
Zona

(10) Patent No.: US 9,026,013 B2
(45) Date of Patent: May 5, 2015

(54) SYSTEM AND APPARATUS FOR TONER CHARGING USING CHARGE/METERING BLADE HAVING AN ADJUSTABLE NIP

(71) Applicant: Xerox Corporation, Norwalk, CT (US)

(72) Inventor: Michael F. Zona, Holley, NY (US)

(73) Assignee: Xerox Corporation, Norwalk, CT (US)

( * ) Notice: Subject to any disclaimer, the term of this patent is extended or adjusted under 35 U.S.C. 154(b) by 228 days.

(21) Appl. No.: 13/723,733

(22) Filed: Dec. 21, 2012

(65) Prior Publication Data

US 2014/0178108 A1 Jun. 26, 2014

(51) Int. Cl.
*G03G 15/08* (2006.01)

(52) U.S. Cl.
CPC ..... *G03G 15/0812* (2013.01)

(58) Field of Classification Search
CPC ..... G03G 15/0812; G03G 2215/0866
USPC ..... 399/283, 284
See application file for complete search history.

(56) References Cited

U.S. PATENT DOCUMENTS

| | | | | |
|---|---|---|---|---|
| 5,747,215 | A | 5/1998 | Ong et al. | |
| 2006/0045576 | A1* | 3/2006 | Oshika | 399/284 |
| 2010/0062359 | A1* | 3/2010 | Bensing et al. | 430/109.4 |
| 2011/0086306 | A1 | 4/2011 | Bayley et al. | |
| 2012/0129088 | A1 | 5/2012 | Kmiecik-Lawrynowicz et al. | |
| 2012/0129089 | A1 | 5/2012 | Kmiecik-Lawrynowicz et al. | |
| 2012/0163835 | A1* | 6/2012 | Sasai et al. | 399/9 |

* cited by examiner

*Primary Examiner* — David Bolduc
*Assistant Examiner* — Barnabas Fekete
(74) *Attorney, Agent, or Firm* — Fay Sharpe LLP

(57) ABSTRACT

A developer apparatus including a housing defining a chamber storing a supply of toner, and a developer roll disposed in the chamber, the developer roll configured to rotate about a longitudinal access to transport toner on a surface of the developer roll to a development zone. The developer apparatus also includes a charge/metering blade having a curved section configured to contact the surface of the developer roll so as to form an adjustable contact nip. The charge/metering blade also includes an overhang configured to control an amount of toner to enter the adjustable contact nip formed by the at least one curved section of the charge/metering blade.

20 Claims, 6 Drawing Sheets

SYSTEM AND APPARATUS FOR TONER CHARGING USING CHARGE/METERING BLADE HAVING AN ADJUSTABLE NIP

BACKGROUND

Many home and small businesses use of printers, copiers, facsimile machine, multifunction device, and the like, utilize expensive toner cartridges. These toner cartridges generally correspond to non-magnetic development systems, which may or may use conventionally or chemically manufactured toner. Conventional toner is generally formed using a pulverization technique that forms the small toner particles from larger manufactured toner components. Uniformity in size and shape of the resulting small toner particles does not generally result. In contrast, chemically manufactured toners are generally uniform in size and shape. Two recognized types of chemically produced toners include suspension polymerization toner and an emulsion aggregation toner. As these toners have smaller particles than conventional toners, less toner need be manufactured and used to provide comparable, if not higher quality, print results.

In some conventional toner cartridges, toner is filled into a cartridge sump, and a paddle, or gravity, is used to load a supply roller with toner, which is then transferred to a development roll. As the development roll rotates, the toner is charged and metered in the nip of the charge/metering blade that is held in contact against the roll with a pre-determined force. After the blade, enough charged toner is brought into a development zone to support good solid area and halftone uniformity on the latent image on a photoreceptor. The blade is typically a thin piece of steel, bronze or copper that is mounted onto a rigid holder that is mounted to the development housing. The physical properties and the dimensions of the blade (i.e. modulus, thickness, free length, etc.) are selected to provide an optimal normal force against the development that will provide good charging and metering of the toner that enters into the nip formed between the two. This contact width is typically less than one millimeter in the process direction. Toner must be able to charge and flow well enough in this one-millimeter nip to enable a sufficiently charged developed mass on the photoreceptor when brought into contact with the latent image. Such operations and configurations work well with conventional toners and certain chemically produced toners.

However, such a cartridge is ineffective to sufficiently charge toner chemically produced by means of the emulsion aggregation process, as set forth in U.S. Pat. No. 5,747,215, the entirety of which is incorporated by reference herein. For example, toners produced using the suspension polymerization process can achieve a tribo charge of 30-40 uC/gm with 0.3-0.4 mg/cm2 of toner mass on the roll prior to development. In contrast, emulsion aggregation toners typically reach 15-20 uC/gm at approximately the same amount of toner mass on the roll prior to development. Thus, there is a need for a simple and easily implemented apparatus, module, and system to increase the tribo charge of emulsion aggregation toners in existing toner cartridges without incurring any substantial increase in the cost of materials, redesign, or manufacture.

INCORPORATION BY REFERENCE

The following references, the disclosures of which are incorporated herein by reference, in their entirety, are mentioned.

U.S. Pat. No. 5,747,215 issued May 5, 1998 and entitled "TONER COMPOSITIONS AND PROCESSES" by Ong et al.

U.S. Publication No. 2012-0129089 published May 24, 2012 and entitled "TONER COMPOSITIONS AND DEVELOPERS CONTAINING SUCH TONERS" by Kmiecik-Lawrynowicz et al.

U.S. Publication No. 2012-0129088 published May 24, 2012 and entitled "NON-MAGNETIC SINGLE COMPONENT EMULSION/AGGREGATION TONER COMPOSITION" by Kmiecik-Lawrynowicz et al.

U.S. Publication No. 2011-0086306 published Apr. 14, 2011 and entitled "TONER COMPOSITIONS" by Bayley et al.

BRIEF DESCRIPTION

In one embodiment of this disclosure, described is a developer apparatus. The developer apparatus includes a housing defining a chamber for storing a supply of toner therein. The developer apparatus also includes a developer roll disposed in the chamber, the developer roll configured to rotate about a longitudinal access to transport toner on a surface of the developer roll to a development zone. In addition, the developer apparatus includes a charge/metering blade having at least one curved section configured to contact the surface of the developer roll, the at least one curved section forming an adjustable contact nip therebetween, wherein the at least one curved section is configured to frictionally charge toner on the surface of the developer roll.

In another embodiment of this disclosure, described is a printing system that includes a developer apparatus. The developer apparatus includes a housing defining a chamber that stores a supply of toner, a developer roll disposed in the chamber that is configured to rotate about a longitudinal access to transport toner on a surface of the developer roll to a development zone, and a charge/metering blade having at least one curved section configured to contact the surface of the developer roll. The at least one curved section of the charge/metering blade forms an adjustable contact nip between the blade and the developer roll, and is configured to frictionally charge toner on the surface of the developer roll. The printing system further includes a photoreceptor in contact with the developer roll, the photoreceptor configured to rotate about a longitudinal access and receive toner on a surface of the photoreceptor from the developer roll in the development zone. In addition, the printing system includes a charging member in proximity to the photoreceptor, which is configured to generate a predetermined electrical charge on the photoreceptor, and a transfer belt in contact with the photoreceptor, the transfer belt configured to receive an image formed on the photoreceptor of toner and transfer the image to an output media.

In still another embodiment of this disclosure, described is a charge/metering blade operatively associated with a developer apparatus. The charge/metering blade includes a rigid holder operatively coupled to an interior of a housing of the developer apparatus, and a curved section forming an adjustable contact nip around a portion of a developer roll located within the interior of the housing, the curved section configured to frictionally charge toner on the surface of the developer roll.

DETAILED DESCRIPTION

Figure 1:
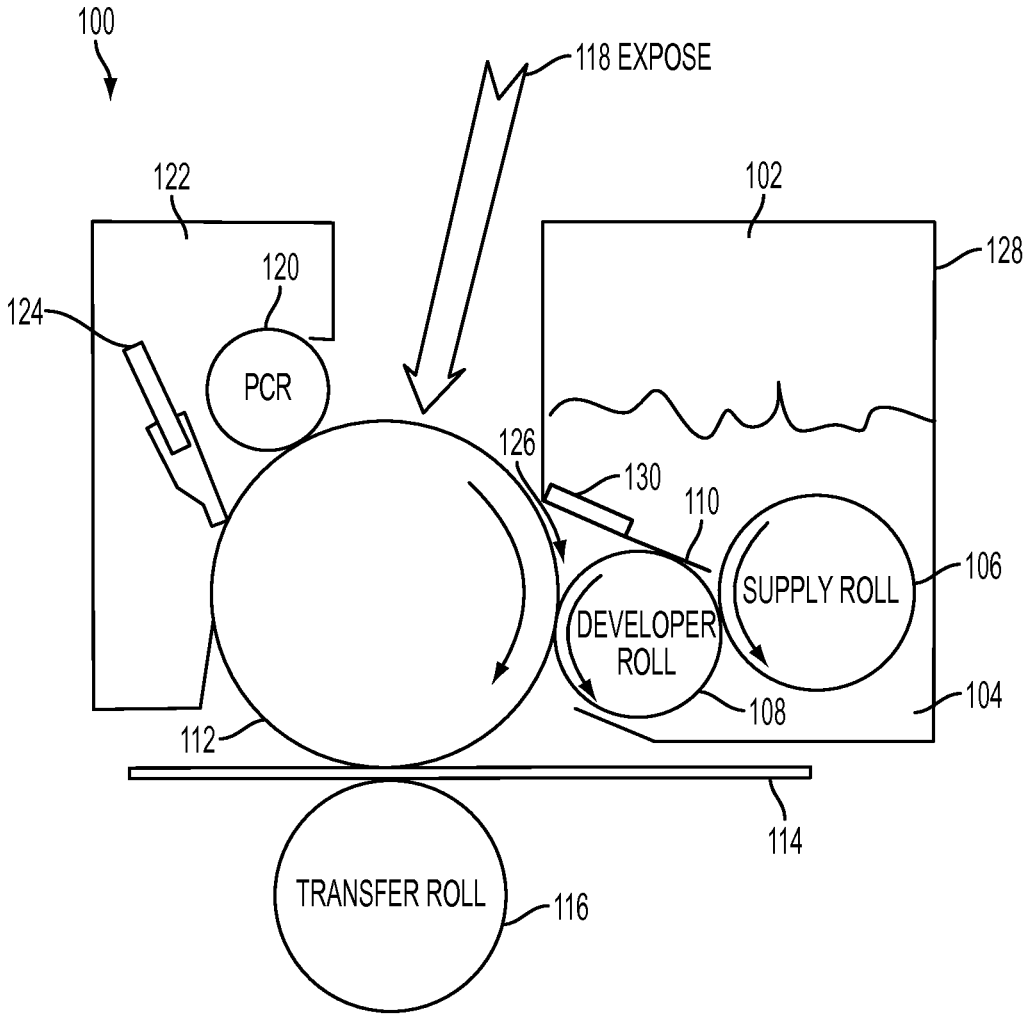
FIG. 1 illustrates an example developer apparatus according to an exemplary embodiment of this disclosure.

One or more embodiments will now be described with reference to the attached drawings, wherein like reference numerals are used to refer to like elements throughout.

As briefly discussed above, toners produced using suspension polymerization processes can achieve a tribo charge of 30-40 uC/gm with 0.3-0.4 mg/cm2 of toner mass on a developer roll prior to development. The chemistry and solvents used in the suspension polymerization process allow for high charging particles in the non-magnetic development system. The emulsion aggregation toner process creates similar size and shape uniformity, but may require the use of solvents and surfactants that inhibit the chargeability of the final toner particle and typically reach only 15-20 uC/gm at approximately the same amount of toner mass on the roll prior to development.

According to one aspect of this disclosure, provided is the ability to control the tribo charge of toners, such as emulsion aggregation toners, via an adjustable contact nip formed by a charge/metering blade. The blade includes curved section that adjusts the contact nip to increase the amount of friction imparted to the toner and thus increase the tribo charge of emulsion aggregation toners in existing toner cartridges without incurring any substantial increase in the cost of materials, redesign, or manufacture.

Figure 2:
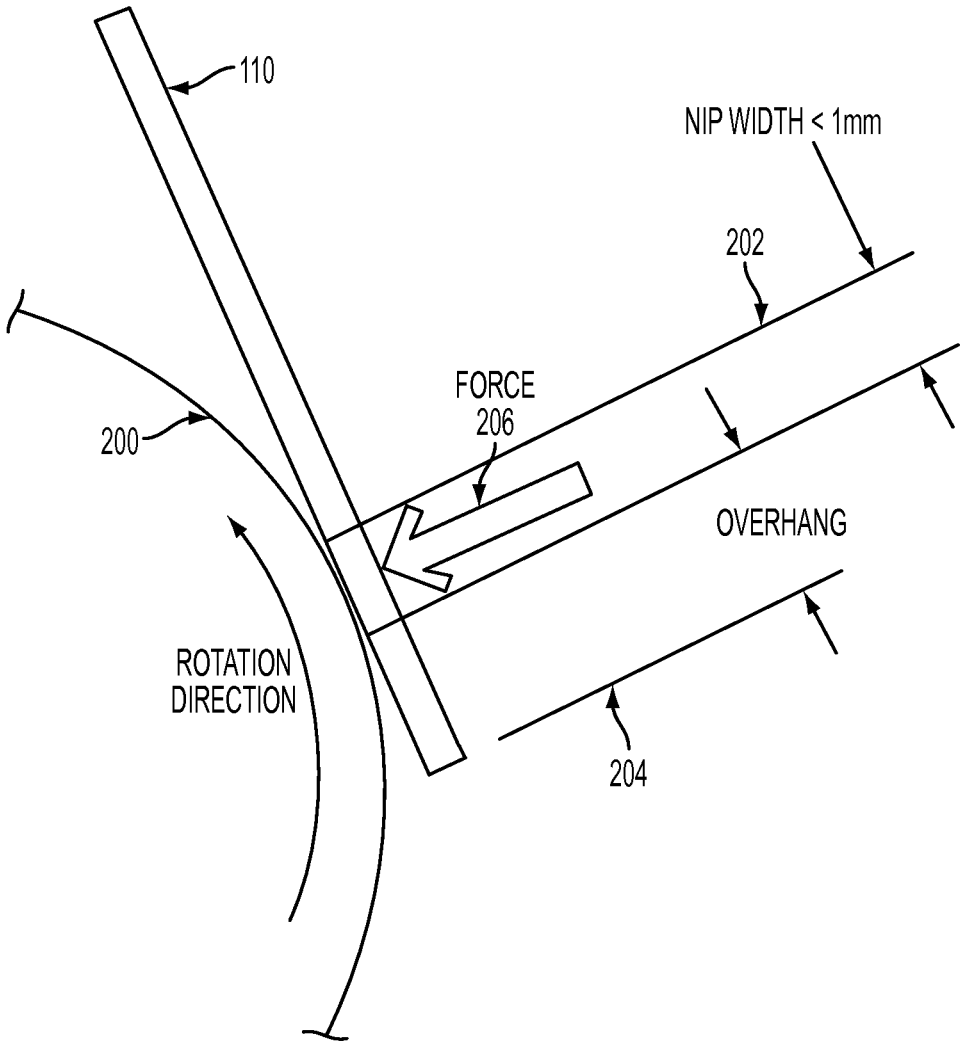
FIG. 2 is a detailed view of a charging/metering blade used in the developer apparatus of FIG. 1.

Turning now to FIGS. 1 and 2, there is shown a cross section of a non-magnetic, single component development apparatus 100 having a static contact nip 202. It will be appreciated that the example of FIGS. 1 and 2 are representative of any type of development apparatus and are used to illustrate components and operation of a suitable development apparatus. Accordingly, the development apparatus 100 of FIGS. 1 and 2 is used as an example only. The apparatus 100 includes a development housing 128 that may include a cartridge sump 102 in which is stored toner 104. The toner 104 may be a conventionally produced toner, a chemically produced toner (e.g., via suspension polymerization or emulsion aggregation), or the like. For example purposes, reference is made hereinafter to the toner 104 being representative of a conventionally produced toner using a mechanical process. For example, a base plastic is melt mixed in a pigment and special ingredients to form a block of composite plastic of the basic toner material. This composite block of toner material is then pulverized via a mechanical action to a fine powder. The fine powder must then be properly filtered to remove oversized chunks and ultra-fine particles. The material remaining is typically non-uniform angular particles, with a somewhat wide distribution of size and shape.

A paddle (not shown), or gravity, is used to load a supply roller 106 with toner 104 from the cartridge sump 102. This toner 104 on the supply roller 106 is then transferred to a developer roll 108. As the developer roll 108 rotates, the toner 104 on the developer roll 108 is charged and metered in the nip 202 of the charge/metering blade 110 that is held in contact with the surface 200 of the developer roll 108 with a pre-determined force 206. The frictional contact between the charge/metering blade 110 and the surface 200 of the developer roll 108 causes the toner 104 to become triboelectrically charged. The charged toner 104 then is moved from the surface 200 of the developer roll 108 onto an electrostatic image on the photoreceptor 112.

That is, after the traveling through the nip 202 formed between the charge/metering blade 110 and the surface 200 of the developer roll 108, enough charged toner 104 is brought into the development zone 126 between the developer roll 108 and the photoreceptor 212 to provide solid area coverage and halftone uniformity on the latent image on the photoreceptor 212. According to one embodiment illustrated in FIGS. 1 and 2, the charge/metering blade 110 may comprise a thin piece of steel, bronze or copper that is mounted onto a rigid holder 130 that is mounted to the development housing 128. The physical properties and the dimensions of the charge/metering blade 110 (i.e. modulus, thickness, free length, etc.) are selected to provide an optimal force 206 against the developer roll 108 so as to provide sufficient charging and metering of the toner 104 that enters into the nip 202 formed between the blade 116 and the developer roll 108.

Concurrently with the rotation of the developer roll 108, the photoreceptor 112 also rotates about a longitudinal axis in a direction opposite the direction of rotation of the developer roll 108. A charging member 120 imparts a charge to the photoreceptor 112 during rotation. The charge imparted on the photoreceptor 112 is similar to the charge imparted to the toner 104 so as to prevent background development of the charged tone 104*r*. The charged photoreceptor 112 continues rotation until exposure 118 of an image occurs, resulting in a latent image formation on the photoreceptor 112. Where the photoreceptor 112 is exposed, the surface charge of the photoreceptor 112 is reduced to a less negative voltage than the charged toner 104. The photoreceptor 112 continues rotation into the development zone 126, whereupon toner 104 having the appropriate charge on the developer roll 108 is transferred to the photoreceptor 112. The developed image formed on the photoreceptor 112 may then be transferred to an intermediate transfer belt 114 or output media (depending upon configuration of the image forming machine in which the developer apparatus 100 is implemented). Accordingly, the latent image from the photoreceptor 112 (monochromatic) or transfer belt 114 is then transferred to output media, e.g., paper, transparency, etc. The photoreceptor 112 then continues rotation with a cleaner blade 124 removing any excess toner 104 not transferred to the output media into the reservoir 122 component of the developer apparatus 100.

As illustrated in the example developer apparatus 100 of FIGS. 1 and 2, the contact width may be less than one millimeter in the process direction. The example developer apparatus 100 illustrates a tribo charge of 30-40 uC/gm with 0.3-0.4 mg/cm2 of toner mass on the developer roll 108 prior to development. Accordingly, the conventional toner 104 enters this one millimeter nip 202 to enable a sufficiently charged developed mass on the photoreceptor 112 when brought into contact with the latent image on the photoreceptor 112 via the exposure 118.

Figure 3:
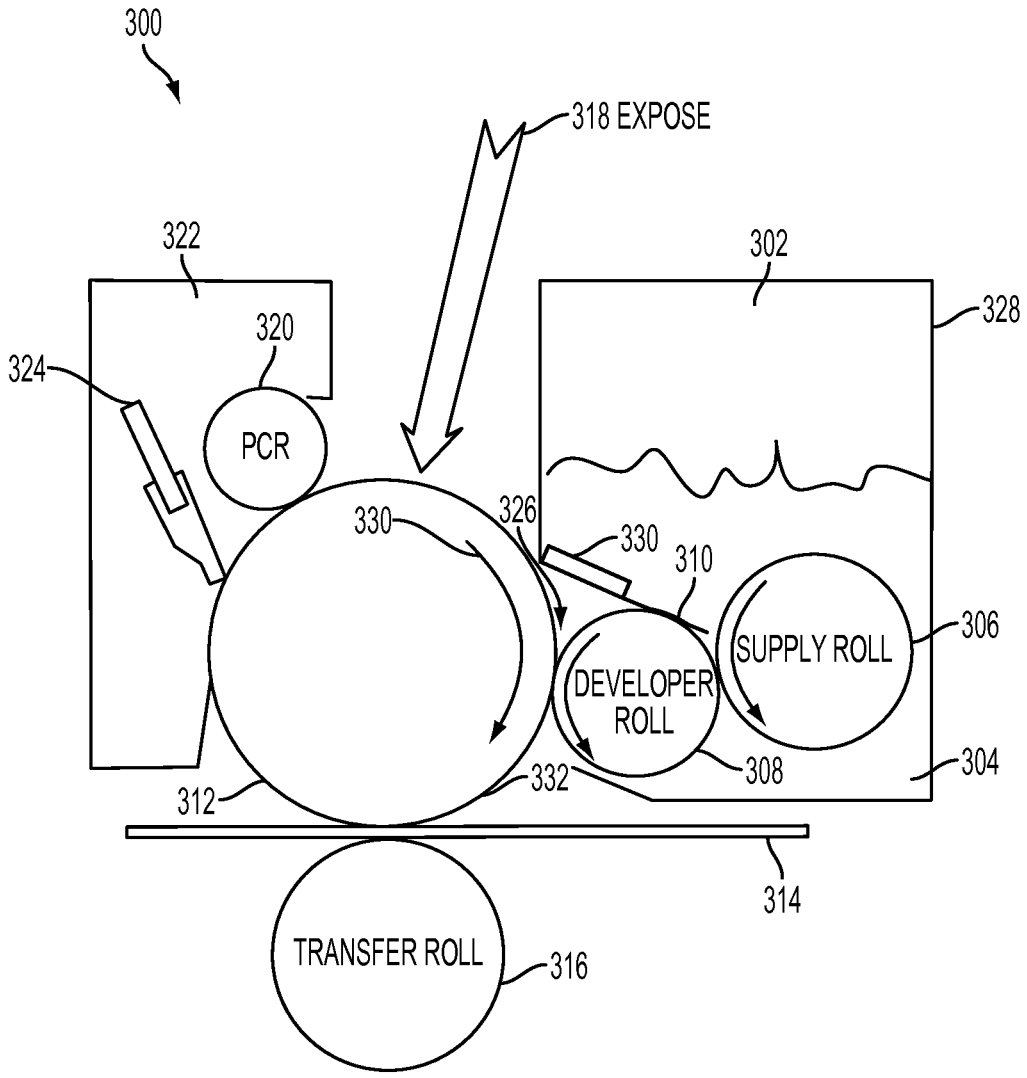
FIG. 3 illustrates an example developer apparatus according to an exemplary embodiment of this disclosure.
Figure 4:
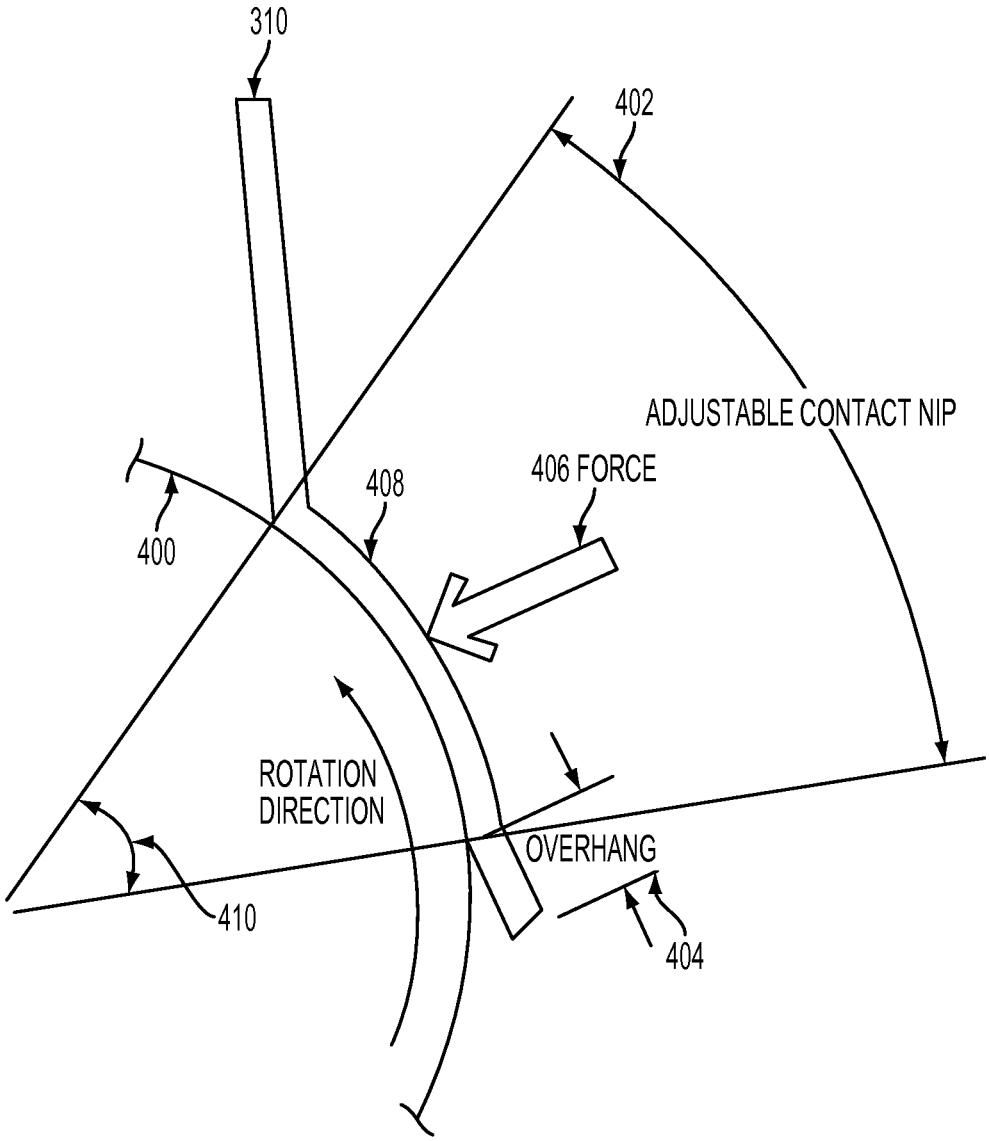
FIG. 4 is a detailed view of a charging/metering blade used in the developer apparatus of FIG. 3.

Turning now to FIGS. 3 and 4, there is shown a developer apparatus 300 having a charge/metering blade 310 with an adjustable contact nip 402 in accordance with one embodiment. As shown in FIG. 3, as discussed above with respect to FIGS. 1 and 2, the developer apparatus 300 includes a development housing 328 defining a chamber 302 in which may be stored toner 304. The toner 304 of FIG. 3 may be a chemical toner that may prepared by emulsion aggregation, i.e., a chemical process used to "grow" very small, uniform particle sizes from even smaller (sub-micron) size polymer resins, waxes and pigments. The emulsion aggregation process can deliver the desired size and narrow particle size distribution required for desired image quality. It will be appreciated that the small size and the relative uniformity of all the particles in a particular batch of emulsion aggregation toner is more predictable than the conventional mechanical process of pulverizing extruded plastic for toner, as well as being less energy intensive. It will also be appreciated that emulsion refers to the synthetic chemical process to form latex toner resin and aggregation means to bring the toner ingredient's particles together to form the desired particle size and spherical shape.

The chamber 302, or cartridge sump, is configured to store an amount of toner 304 that may be located on or near a supply roll 306. A paddle (not shown), or gravity, is used to load a supply roller 306 with toner 304 from the cartridge sump 302. The supply roll 306 is configured to rotate in a counterclockwise direction, delivering toner 304 from the sump 302 to a developer roll 308. As the developer roll 308 rotates, the toner 304 on the developer roll 308 travels through the overhang 404 of a charge/metering blade 310, becoming metered to approximately one to two layers of toner 304 remaining on the surface 400 of the developer roll 308.

As discussed above with respect to FIGS. 1-2, while the developer roll 308 rotates, photoreceptor 312 also rotates about a longitudinal axis in a direction opposite the direction of rotation of the developer roll 108. A charging member 320 imparts a charge to the surface 332 of the photoreceptor 312 during rotation. The charged photoreceptor 312 continues rotation until exposure 318 of an image occurs, resulting in a latent image formation on the photoreceptor 312. The photoreceptor 112 continues rotation into the development zone 326, whereupon toner 304 on the developer roll 308 is transferred to the surface 332 of the photoreceptor 112. The developed latent image thus formed on the surface 332 of the photoreceptor 312 may then be transferred to output media along the transfer belt 114 in conjunction with the transfer roll 116 below the photoreceptor 112 so as to allow the latent image on the photoreceptor 112 to be transferred to the output media. The photoreceptor 112 then continues rotation with a cleaner blade 124 removing any excess toner 104 not transferred to the output media into the reservoir 122 component of the developer apparatus 100.

The charge/metering blade 310 may comprise a thin piece of steel, bronze or copper that is mounted onto a rigid holder 330 that is mounted to the development housing 328. The charge/metering blade 310, depicted in FIGS. 3 and 4, includes an adjustable contact nip 402, an overhang 404, and curved section 408. As illustrated in FIG. 4, the curved section 408 of the charge/metering blade 310 is formed on the blade 310 so as to curve around the surface of the developer roll 400. It will be appreciated that the length of the curved section 408 as well as the adjustable contact nip 402 associated therewith is suitably dependent upon and may be adjusted to compensate for the size of the developer roll 308, the type of toner 304 being used, the size of the developer apparatus 300 and relative positioning of the internal components within the development housing 328, the speed at which the developer roll 308 rotates, the amount of tribo charge desired, and the like. It will therefore be appreciated that such factors may be used to properly determine the thickness of the blade 310, the length of the overhang 404, the contact angle 410, and the like.

Figure 5:
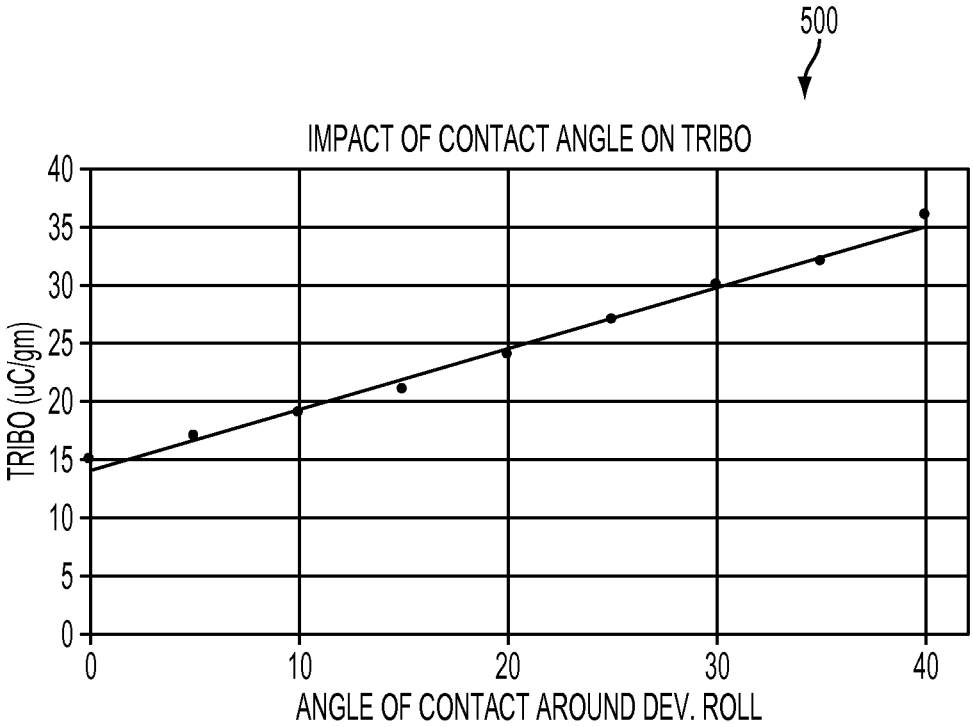
FIG. 5 is a graphical illustration of changes in contact angle of the charging/metering blade relative to tribo charging of the developer apparatus of FIGS. 3-4.

It will further be appreciated that the above-discussed factors may result in the charge/metering blade 310 having a curved portion 408 that creates the adjustable contact nip 402 being positioned within the chamber 302 of the development housing 328 at a location so as to provide a suitable contact angle 410 allowing for a greater or lesser amount of the curved portion 408 to contact the surface 400 of the developer roll 310 for generation of a preselected charge. FIG. 5 illustrates a graphical representation 500 of the increase in triboelectric charge relative to the increase in the contact angle 410 of the adjustable contact nip 402 in accordance with the embodiments discussed herein.

Accordingly, the illustration of FIG. 4 is intended to depict one example implementation of a developer apparatus in accordance with the subject disclosure. The curved section 408 enables the toner 304 to spend a greater amount of time under the frictional force 406 of the charge/metering blade 310 due to the adjustable contact nip 402 formed between the blade 310 and the surface 400 of the developer roll 308.

Returning to the illustrations of FIG. 3, the toner 304 on the surface 400 of the developer roll 308 travels under the curved section 408 of the charge/metering blade 310 through the adjustable contact nip 402, so as to be subjected to force 406, and thus friction within the charge/metering blade 310 and the surface 400 of the developer roll 308. As addressed above, this frictional contact between the charge/metering blade 310 and toner 304 on the surface 400 of the developer roll 308 causes the toner 304 to become triboelectrically charged. The charged toner 304 then is moved from the surface 400 of the developer roll 308 onto an electrostatic image on the photoreceptor 312. That is, after the traveling through the contact nip 402 formed between the charge/metering blade 310 and the developer roll surface 400, a sufficient amount of charged toner 104 is brought into the development zone 326 between the developer roll 308 and the photoreceptor 312, providing solid area coverage and halftone uniformity on the latent image on the photoreceptor 312.

Concurrently with the rotation of the developer roll 308, the photoreceptor 312 also rotates about a longitudinal axis in a direction opposite the direction of rotation of the developer roll 308. A charging member 320 imparts a charge to the photoreceptor 312 during rotation. The charge imparted on the photoreceptor 312 is similar to the charge imparted to the toner 304 so as to prevent background development in the unexposed areas of the photoreceptor surface 332. The charged photoreceptor 312 continues rotation until exposure 318 of an image occurs, resulting in a latent image formation on the photoreceptor 312. The exposed areas of the photoreceptor 312 have a lower charge than the toner 304 on the surface 400 of the developer roll 308. The photoreceptor 312 continues rotation into the development zone 326, whereupon toner 304 having the appropriate charge on the developer roll 308 is transferred to the photoreceptor 312. The developed latent image on the surface 332 of the photoreceptor 312 may be transferred directly to output media, e.g., paper, transparency, etc., or as discussed in greater detail below with respect to FIG. 6, to an intermediate transfer belt 314 so as to allow the latent image on the photoreceptor 312 to eventually be transferred from the belt 314 to output media. The photoreceptor 312 thereafter continues rotation with a cleaner blade 324 removing any excess toner 304 not transferred to the output media into the cleaning housing 322 component of the developer apparatus 300.

Thus, as illustrated in FIGS. 3 and 4, the increased amount of time the toner 304 spends under the frictional force 406 of curved section 408 of the charge/metering blade 310 correspondingly increases the associated tribo charge of the toner 304. Such an implementation provides a uniform layering of the toner 304 on the surface 400 of the developer roll 308, while also providing sufficient time under frictional force 406 to generate the desired tribo charge on the toner 304.

Figure 6:
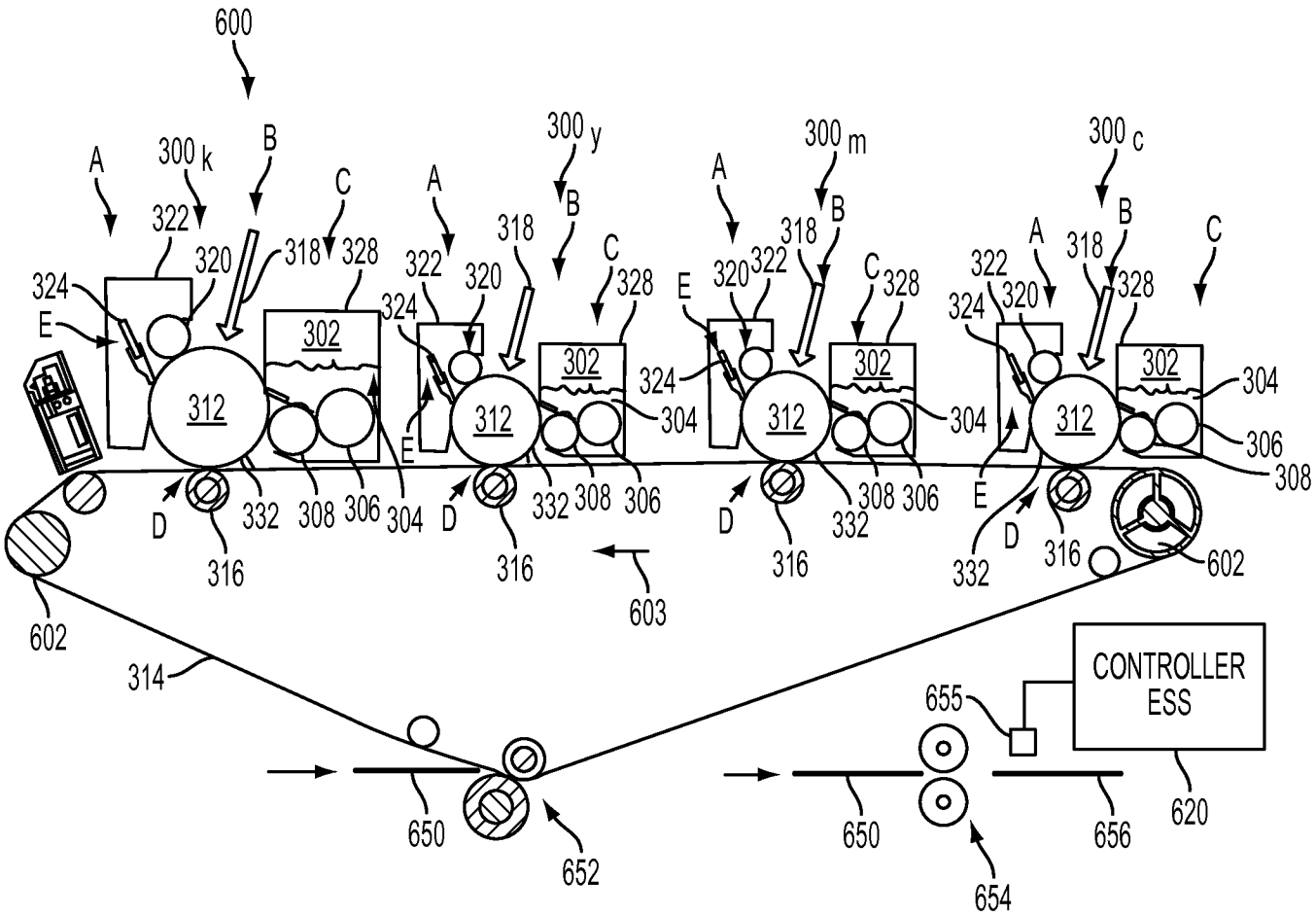
FIG. 6 illustrates a color image forming machine according to an exemplary embodiment of this disclosure employing the developer apparatus of FIGS. 3-4.

Turning now to FIG. 6, there is illustrated an example image forming machine 600 implementing the developer apparatus 300 having an adjustable contact nip 402. The image forming machine 600, can be a xerographic or electrophotographic image forming device such as a multi-color digital printer, a digital color copy system, or the like. It includes a plurality of marking engines, depicted in FIG. 6 generally as the developer apparatus 300, forming associated color separations that are combined to form a color print image, as described in further detail below. It will be appreciated that while illustrated in FIG. 6 as a multicolor image forming machine, it will be appreciated that the developer apparatus 300 depicted in FIGS. 3-4 may be implemented in a single marking engine device, i.e., a monochromatic image forming device, and the use of a multicolor device herein is intended for example purposes only. Hereinafter, with respect to FIG. 6, the terms "developer apparatus" and "marking engine" are used interchangeably unless otherwise set forth.

The image forming machine shown by way of example is of a tandem architecture system including an intermediate transfer belt 314 entrained about a plurality of rollers 602 and adapted for movement in a process direction illustrated by arrow 603. Belt 314 is adapted to have transferred thereon a plurality of toner images, which are formed by the developer apparatuses referred to generally at 300.

Each developer apparatus 300 forms an associated color separation by developing a single colorant toner image in succession on the belt 314 so that the combination of the color separations forms a multi-color composite toner image. While the color separations may be combined in different ways, they are each separately developed onto associated photoreceptors and then transferred to a compliant single-pass intermediate belt 314. When all of the desired color separations have been built up on the intermediate belt 314, the entire image is transferred to a substrate, such as paper, to form a print image.

For the purposes of example, which should not be considered limiting, the image forming machine 600 described herein is a CMYK marking system having four marking engines, i.e., developer apparatuses 300, which include: a cyan developer apparatus $\mathbf{300}_C$ forming a cyan color separation; a magenta developer apparatus $\mathbf{300}_M$ forming a magenta color separation; a yellow developer apparatus $\mathbf{300}_Y$ forming a yellow color separation; and a black developer apparatus $\mathbf{300}_K$ forming a black separation. However, it should be appreciated that a larger or smaller number of marking engines 300 can be used. For example, a larger number of marking engines 300 can be used for generating Extended colorant set images which typically include these four process-color colorant separations (CMYK) plus one or more additional color separations such as green, orange, violet, red, blue, white, varnish, light cyan, light magenta, gray, dark yellow, metallics, and so forth.

In other examples, the image forming machine 600 can be an n-color imaging system (with n≥3) having n+1 marking engines 300, where the $n+1^{th}$ marking engine $\mathbf{300}_{OC}$ uses clear toners for form an overcoat layer on top of the other toners in the printed image. In one non-limiting example, an image forming machine may include marking engines $\mathbf{300}_{OC}$, $\mathbf{300}_C$, $\mathbf{300}_M$, $\mathbf{300}_Y$ and $\mathbf{300}_K$ consecutively coupled to the intermediate transfer belt 314, as will be appreciated.

Referring now to FIG. 6 in conjunction with FIGS. 3-4, each developer apparatus $\mathbf{300}_C$, $\mathbf{300}_M$, $\mathbf{300}_Y$, and $\mathbf{300}_K$ includes a charge retentive member in the form of the drum-shaped photoreceptor 312, having a continuous, radially outer charge retentive surface 605 constructed in accordance with well-known manufacturing techniques. The photoreceptor 312 is supported for rotation such that its surface 605 moves in a process direction shown at 330 past a plurality of xerographic processing stations (A-E) in sequence.

Initially, successive portions of the photoreceptor surface 332 pass through a first charging station A. At charging station A, a corona discharge device indicated generally at 320, charges portions of the photoreceptor surface 332 to a relatively high, substantially uniform potential during a charging operation.

Next, the charged portions of the photoreceptor surface 332 are advanced through a first exposure station B. At exposure station B, the uniformly charged photoreceptor charge retentive surface 332 is exposed to a scanning device (referenced generally as exposure 318) that causes the charge retentive surface to be discharged forming a latent image of the color separation of the corresponding engine. The scanning device generating the exposure 318 can be a Raster Output Scanner (ROS), non-limiting examples of which can include a Vertical Cavity Surface Emitting Laser (VCSEL), an LED image bar, or other known scanning device. The ROS generating exposure 318 is controlled by a controller 620 to discharge the charge retentive surface in accordance with the digital color image data to form the latent image of the color separation. A non-limiting example of the controller 620 can include an Electronic Scanning Subsystem (ESS) shown in FIG. 6, or one or more other physical control devices. The controller 620 may also control the synchronization of the belt movement with the engines $\mathbf{300}_C$, $\mathbf{300}_M$, $\mathbf{300}_Y$, and $\mathbf{300}_K$ so that toner images are accurately registered with respect to previously transferred images during transfer from the latter to the former.

The marking engines $\mathbf{300}_C$, $\mathbf{300}_M$, $\mathbf{300}_Y$, and $\mathbf{300}_K$ also include a development station C, also referred to as a development housing 328. The development housing 328 includes a chamber 302 holding toner 304. The development housing 328 includes one or more supply rolls 306 for moving the toner 304 into contact with a brush, roller, or other toner applicator, indicated generally as the developer roll 308 (as shown in FIGS. 3-4), advancing the toner 304 into contact with the electrostatic latent images on the photoreceptor 312 to form the toner image for the associated color separation as controlled by controller 620. The toner 304 not applied to the surface 332 of the photoreceptor 312 is returned to the holding chamber 302.

At a transfer station D, an electrically biased transfer roll 316 contacting the backside of the intermediate belt 314 serves to effect combined electrostatic and pressure transfer of toner images from the photoreceptor 312 of the developer apparatus 300 to the transfer belt 314. The transfer roll 316 may be biased to a suitable magnitude and polarity so as to electrostatically attract the toner particles from the photoreceptor 312 to the transfer belt 314 to form the toner image of the associated color separation on the transfer belt 314.

After the toner images are transferred from the photoreceptor 312, the residual toner particles carried by the non-image areas on the photoreceptor surface are removed from it at cleaning station E. A cleaning housing 322 supports therewithin a cleaning blade/brushes 324 which remove the toner 304 from the photoreceptor surface 332.

After all of the toner images have been transferred from the engines $\mathbf{300}_C$, $\mathbf{300}_M$, $\mathbf{300}_Y$, and $\mathbf{300}_K$ the multi-color composite toner image is transferred to a substrate 650, such as plain paper, by passing through a conventional transfer device 652.

The substrate 650 may then be directed to a fuser device 654 to fix the multi-color composite toner image to the substrate to form the color print 656. The fuser device 656 may include a heated fuser roller and a back-up roller (not shown), such that the back-up roller is resiliently urged into engagement with the fuser roller to form a nip through which the sheet of paper passes. In the fusing operation, the toner particles coalesce with one another and bond to the sheet in image configuration, forming a multi-color image thereon. After fusing, the finished sheet is discharged to a finishing station where the sheets are compiled and formed into sets which may be bound to one another. These sets are then advanced to a catch tray for subsequent removal therefrom by the printing machine operator.

It will be appreciated that variants of the above-disclosed and other features and functions, or alternatives thereof, may be combined into many other different systems or applications. Various presently unforeseen or unanticipated alternatives, modifications, variations or improvements therein may be subsequently made by those skilled in the art which are also intended to be encompassed by the following claims.

What is claimed is:

1. A developer apparatus, comprising:

a housing defining a chamber storing a supply of toner therein;

a developer roll disposed in the chamber, the developer roll configured to rotate about a longitudinal access to transport toner on a surface of the developer roll to a development zone; and a charge/metering blade having at least one curved section configured to contact the surface of the developer roll, the at least one curved section forming an adjustable contact nip therebetween, wherein the at least one curved section is configured to frictionally charge toner on the surface of the developer roll, and wherein the at least one curved section is contoured around the surface of the developer roll.

2. The developer apparatus of claim 1, wherein the charge/metering blade further comprises an overhang, the overhang configured to control an amount of toner to enter the adjustable contact nip formed by the at least one curved section of the charge/metering blade.

3. The developer apparatus of claim 2, wherein the adjustable contact nip formed by the at least one curved section is adjusted in accordance with a size of the developer roll.

4. The developer apparatus of claim 2, wherein the adjustable contact nip formed by the at least one curved section is adjusted in accordance with a type of the toner.

5. The developer apparatus of claim 4, wherein the adjustable contact nip formed by the at least one curved section is adjusted in accordance with a predetermined tribo charge to be generated by the charge/metering blade on the toner.

6. The developer apparatus of claim 2, wherein a contact angle of the at least one curved section is determined in accordance with a size of the developer roll.

7. The developer apparatus of claim 2, wherein the charge/metering blade is positioned within the chamber so as to allow the at least one curved section to be in contact with toner on the developer roll at a predetermined position within the chamber.

8. The developer apparatus of claim 7, further comprising a supply roll disposed in the chamber and configured to rotate about a longitudinal access in the same direction as the developer roll, the supply roll further configured to supply the toner to the developer roll at the overhang.

9. The developer apparatus of claim 2, wherein the adjustable contact nip is increased in response to a speed of rotation of the developer roll.

10. The developer apparatus of claim 2, wherein the charge/metering blade is a metal.

11. The developer apparatus of claim 1, wherein the toner is an emulsion aggregation toner.

12. The developer apparatus of claim 1, further comprising a photoreceptor in contact with the developer roll, the photoreceptor configured to:

rotate about a longitudinal access in a direction opposite the rotation of the developer roll; and receive toner on a surface of the photoreceptor from the developer roll in the development zone.

13. The developer apparatus of claim 12, further comprising a cleaning housing.

14. The developer apparatus of claim 13, wherein the cleaning housing includes a cleaner blade in contact with the photoreceptor, the cleaner blade configured to remove toner adhering to the photoreceptor.

15. The developer apparatus of claim 14, wherein the cleaning housing further comprises a charging member in proximity to the photoreceptor, the charging member configured to generate a predetermined electrical charge on the photoreceptor.

16. A printing system, comprising:

a developer apparatus, including:

a housing defining a chamber storing a supply of toner therein, a developer roll disposed in the chamber, the developer roll configured to rotate about a longitudinal access to transport toner on a surface of the developer roll to a development zone, and a charge/metering blade having at least one curved section configured to contact the surface of the developer roll, the at least one curved section forming an adjustable contact nip therebetween, wherein the at least one curved section is configured to frictionally charge toner on the surface of the developer roll, and wherein the at least one curved section is contoured around the surface of the developer roll;

a photoreceptor in contact with the developer roll, the photoreceptor configured to rotate about a longitudinal access and receive toner on a surface of the photoreceptor from the developer roll in the development zone;

a charging member in proximity to the photoreceptor, the charging member configured to generate a predetermined electrical charge on the photoreceptor; and a transfer belt in contact with the photoreceptor, the transfer belt configured to receive an image formed on the photoreceptor of toner and transfer the image to an output media.

17. The printing system of claim 16, wherein the charge/metering blade further comprises an overhang, the overhang configured to control an amount of toner to enter the adjustable contact nip formed by the at least one curved section of the charge/metering blade.

18. A charge/metering blade operatively associated with a developer apparatus, comprising:

a rigid holder operatively coupled to an interior of a housing of the developer apparatus; and a curved section forming an adjustable contact nip around a portion of a developer roll located within the interior of the housing, the curved section configured to frictionally charge toner on the surface of the developer roll, and wherein the curved section is contoured around the surface of the developer roll.

19. The charge/metering blade of claim 18, further comprising an overhang configured to control an amount of toner to enter the adjustable contact nip.

20. The charge/metering blade of claim 19, wherein the adjustable contact nip is increased in response to a speed of rotation of the developer roll.

* * * * *